US006489576B2

(12) United States Patent
Ito et al.

(10) Patent No.: US 6,489,576 B2
(45) Date of Patent: Dec. 3, 2002

(54) TRANSPARENT KEYBOARD DEVICE

(75) Inventors: Hideki Ito, Fukushima-ken (JP); Akio Nishijima, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/960,682

(22) Filed: Sep. 21, 2001

(65) Prior Publication Data

US 2002/0056626 A1 May 16, 2002

(30) Foreign Application Priority Data

Sep. 26, 2000 (JP) ..... 2000-292919

(51) Int. Cl.[7] ..... H01H 9/02

(52) U.S. Cl. ..... 200/310; 200/5 A; 200/304; 361/680; 361/816; 400/691; 400/693

(58) Field of Search ..... 200/5 A, 293, 200/308, 310, 317, 304, 305; 341/22; 345/168, 169; 361/680, 816; 400/472, 473, 693, 691

(56) References Cited

U.S. PATENT DOCUMENTS 4,644,326 A * 2/1987 Villalobos et al. ..... 200/302.2
4,671,688 A * 6/1987 Brashears ..... 200/304
6,026,283 A * 2/2000 Stephenson ..... 379/433.07
6,179,500 B1 * 1/2001 Oura et al. ..... 400/691
6,219,227 B1 * 4/2001 Trane ..... 361/683

FOREIGN PATENT DOCUMENTS

JP 2000-112626 4/2000 ..... G06F/3/02

* cited by examiner

*Primary Examiner*—Michael Friedhofer
(74) *Attorney, Agent, or Firm*—Brinks Hofer Gilson & Lione

(57) ABSTRACT

A keyboard device that has an excellent appearance even when viewed from a rear surface side of a transparent keyboard. The keyboard device has a keyboard main body where plural key tops are provided on a support plate, a control board provided on the rear surface side of the support plate, a shield case provided on the rear surface side of the support plate so as to cover the control board, and a case having a rear surface side formed of transparent resin, accommodating the keyboard main body, the control board and the shield case. A resin sheet is provided on the rear surface of the support plate, and the resin sheet is bonded to the support plate except a region corresponding to an edge of the shield case positioned on the rear side of the support plate.

1 Claim, 2 Drawing Sheets

TRANSPARENT KEYBOARD DEVICE

BACKGROUND OF THE INVENTION

1. Field of the Invention

The present invention relates to a keyboard device, and more particularly, to a structure preferably applicable to a keyboard device having a transparent case.

2. Description of the Prior Art

Recently, as an example of well-designed keyboard, provided is a keyboard where appearance-constituting members such as an upper case, a lower case and key tops are formed of transparent resin or translucent resin. This type of keyboard has a transparent or translucent appearance, through which the internal structure of the keyboard main body can be seen, thus the keyboard is of a good design.

FIG. 1 shows an example of the structure of this type of keyboard device. The keyboard device 1 has a keyboard main body 3 to which a large number of key tops 2 are attached, and a case which accommodates the keyboard main body 3. The case is composed of a combination of an upper case 4 which covers the surface side of the keyboard main body 3 and which has a window 4*a* for exposing the key tops 2, and a lower case 5 which covers the rear surface side of the keyboard main body 3. In this example, the upper case 4 and the lower case 5 are formed of transparent resin. The key tops 2 of the keyboard main body 3 are supported on a metal support plate 6.

Further, the control board 7 which controls transmission/reception of various signals between the keyboard device and a computer main body or the like is provided under the keyboard main body 3. To prevent leakage of signals from the control board 7 or to block influence of extraneous disturbances on the control board 7, a shield case 8 having an opened top is attached so as to cover the control board 7 from the rear surface side of the keyboard main body 3. At this time, a bottom plate of the shield case 8, in contact with the bottom surface of the lower case 5, is fixed to the support plate 6 and the lower case 5. Further, a resin sheet 9, with its side facing the lower case 5 being coated, is bonded to a rear surface of the support plate 6.

In the above-described keyboard device, as the lower case 5 in addition to the upper case 4 is formed of transparent resin, the rear surface of the keyboard main body 3, and the shield case 8 and the like can be seen from the rear surface side of the keyboard device. Accordingly, as a well-designed keyboard, the color and appearance viewed from the rear surface side of the keyboard are carefully considered in the design. For example, the coated resin sheet 9 is bonded to the rear surface of the support plate 6 for this purpose. The tint of the coating of the resin sheet 9 is coordinated with that of the shield case 8 for color consistency. Further, the resin sheet 9 covers screws fixing various members on the rear surface of the support plate 6.

However, in each keyboard device, the occurrence of variation in size for manufacturing the shield case and slight distortion of the support plate cannot be avoided. As shown in a cross-sectional view of the keyboard device in FIG. 4, a small gap (denoted by a symbol S) may be formed between the edge of the shield case 8 and the support plate 6 (resin sheet 9) due to the above variation and distortion, and the appearance of the keyboard device viewed from the rear surface side is impaired by the existence of the gap S.

To prevent an occurrence of the gap, the height of side plate of the shield case may be designed to be greater than the conventional height. However, if the shield case is larger, the shield case and the support plate interfere with each other in a contact portion therebetween. As a result, portions of both members to be tightly bonded together may float, otherwise, upon application of force to bring them into close contact, the respective members may be distorted by the force.

SUMMARY OF THE INVENTION

The present invention has been made to solve the above-described problems, and has its object to provide a keyboard device having a structure where an occurrence of a gap between a rear surface of a support plate of a keyboard main body and an edge of a shield case is prevented, and having an excellent appearance even when viewed from a rear surface side of the transparent keyboard.

According to the present invention, the foregoing object is attained by providing a keyboard device comprising: a keyboard main body having plural key tops on a support plate; a control board provided on a rear surface side of the support plate; a blocking member provided on the rear surface side of the support plate so as to cover the control board; and a case, where at least a rear surface side being formed of transparent resin or translucent resin, accommodating the keyboard main body, the control board and the blocking member, wherein a resin sheet is provided on a rear surface of the support plate, and wherein the resin sheet is bonded to the support plate in a region at least except a region corresponding to an edge of the blocking member positioned on the rear surface side.

That is, one feature of the keyboard device of the present invention is that the resin sheet covering the rear surface of the support plate is not bonded to the support plate in a region corresponding to the edge of the blocking member positioned under the support plate. In this structure, as the resin sheet is not bonded to the support plate in the region corresponding to the edge of the blocking member, the sheet somewhat floats from the support plate. As a result, if the size of the blocking member is rather small or if a part of the support plate is somewhat recessed, i.e., a situation to cause a gap is provided as in the case of the conventional structure, a gap is not formed in a contact portion between the resin sheet and the edge of the blocking member, thus the keyboard device has an excellent appearance, even when viewed from the rear surface side. Since the gap caused by manufacturing variation is at most about 0.1 to 0.5 mm, the gap can be sufficiently compensated by the floating of the resin sheet from the support plate.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

Hereinbelow, an embodiment of the present invention will be described with reference to FIGS. 1 to 3. In the following description, the back side of the device from a user's view may be referred to as a "rear side", and the front side of the device, a "front side".

Figure 1:
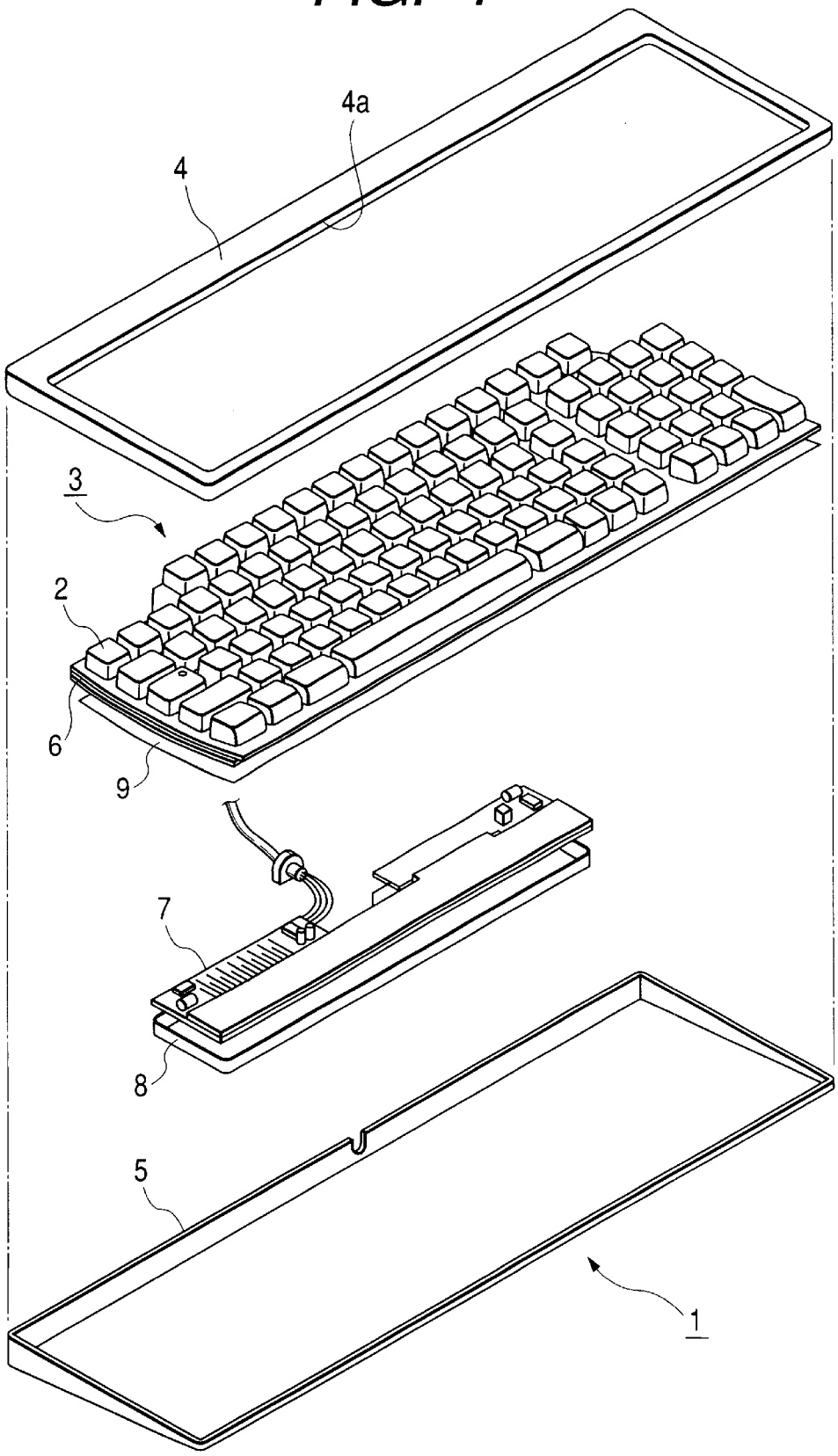
FIG. 1 is an exploded perspective view showing the entire structure of a keyboard device according to an embodiment of the present invention.
Figure 2:
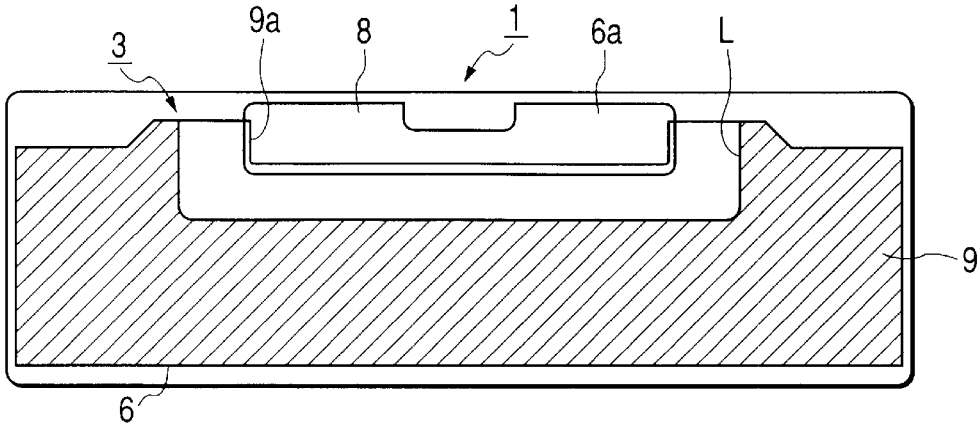
FIG. 2 is a rear view of the keyboard device of the embodiment.

As shown in FIG. 1, a keyboard device 1 of the present embodiment has a keyboard main body 3 to which a large number of key tops 2 are attached, and a case which accommodates the keyboard main body 3. The case is constructed as a combination of an upper case 4 which covers the upper surface side of the keyboard main body 3 and which has a window 4*a* for exposing the key tops 2, and a lower case 5 which covers the lower surface side of the keyboard main body 3. In the present embodiment, the upper case 4 and the lower case 5 are formed of transparent resin. The keyboard main body 3 has a metal support plate 6 which supports the key tops 2, and a resin sheet 9 as a coated resin member of polycarbonate or the like is bonded to a lower surface of the support plate 6. Further, in the present embodiment, the support plate 6 is slightly distorted in a convex shape toward the rear surface side of the keyboard device.

Further, a control board 7 which controls transmission/reception of various signals between the keyboard device and a computer main body or the like is provided under the keyboard main body 3. To prevent leakage of a signal from the control board 7 or to block influence of extraneous disturbance on the control board 7, a shield case 8 (blocking member) of metal such as aluminum, having an opened top, is attached so as to cover the control board 7 from the rear surface side of the keyboard main body 3. In this case, a bottom plate of the shield case 8, in contact with the bottom surface of the lower case 5, is fixed by screws to the support plate 6 and the lower case 5.

The control board 7 is provided in the rear side of the keyboard main body 3. As shown in FIG. 2, the support plate 6 of the keyboard main body 3 extends rearward in a portion where the control board 7 is provided (the extending portion is denoted by reference numeral 6*a*), and the resin sheet 9 is cut so as to avoid the portion where the control board 7 is provided (the cutaway portion is denoted by reference numeral 9*a*). Further, an edge portion (outline) of the shield case 8 covering the control board 7 is provided on the resin sheet 9 on the front side of the keyboard main body 3. In the conventional structure, the entire resin sheet 9 is bonded to the support plate 6, whereas in the present embodiment, in a region (unbonded region) where the shield case 8 exists, from a border line (denoted by a solid line L in the figure) outside the edge of the shield case 8 by certain measurements, the resin sheet 9 is not bonded to the support plate 6, and in the opposite region (bonded region), the resin sheet 9 is bonded to the support plate 6 by adhesive (the bonded region is represented as a hatched region in FIG. 2).

Figure 4:
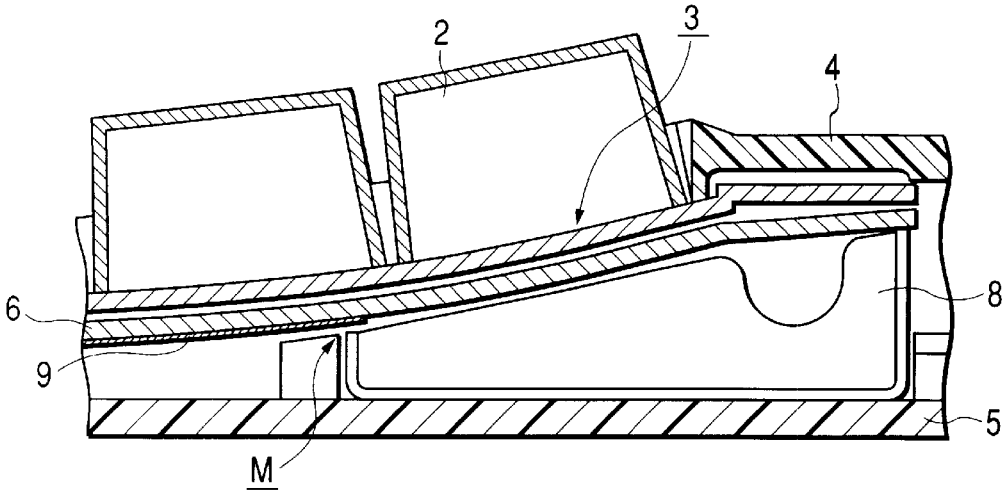
FIG. 4 PRIOR ART
FIG. 4 is a cross-sectional view of an example of a conventional keyboard device.

In the conventional structure, the entire surface of the resin sheet 9 is bonded to the support plate 6 as shown in FIG. 4. As a result, if the size (height) of the shield case 8 is rather small or if a part of the support plate 6 (around a part in contact with the edge of the shield case 8) is somewhat recessed, the gap S is formed between the shield case 8 and the resin sheet 9.

Figure 3:
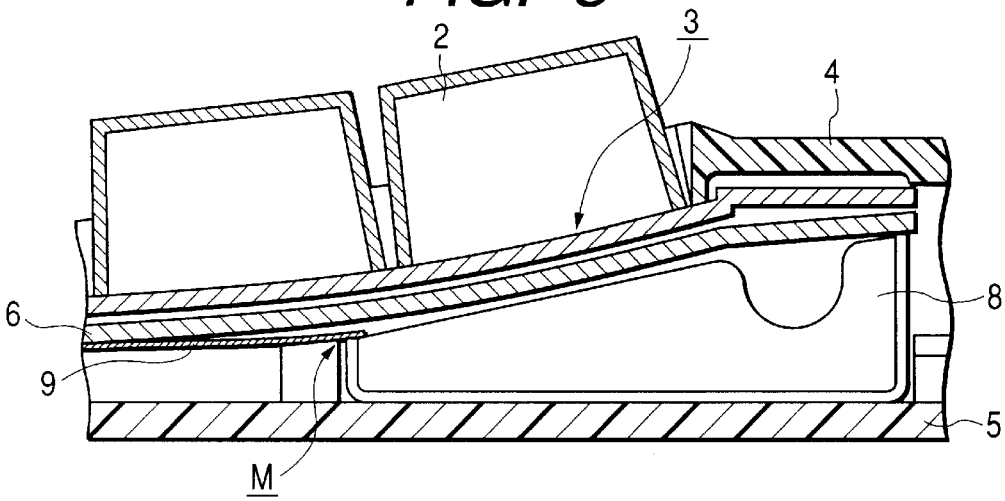
FIG. 3 is a cross-sectional view of the keyboard device of the embodiment.

On the other hand, in the present embodiment, as the resin sheet 9 is not bonded to the support plate 6 in the portion positioned on the edge of the shield case 8, as shown in FIG. 3, the resin sheet 9 somewhat floats from the support plate 6 (denoted by a symbol M in FIG. 3). Further, as the support plate 6 is distorted to be a slight convex shape toward the rear surface side while the polycarbonate resin sheet 9 has certain elasticity, the resin sheet 9 itself is becoming flat in a direction away from the support plate 6 by the spring force of the resin sheet. Accordingly, in the structure of the present embodiment, even if the size of the shield case 8 is rather small or a part of the support plate 6 is recessed, i.e., if a situation to cause a gap is provided as in the case of conventional structure, as the support plate 6 itself and the edge of the shield case 8 are not in close contact but the resin sheet 9 and the edge of the shield case 8 are close contact with each other, a gap is not formed in this portion. Thus, a gap is not seen between the support plate 6 and the shield case 8 even when the keyboard device 1 is viewed from the rear surface side. Accordingly, the present invention provides a keyboard device with an excellent appearance, even when viewed from the rear surface side, and of a good design.

Note that the technical scope of the present invention is not limited to the above-described embodiment, however, various changes can be made without departing from the scope thereof. For example, particular descriptions of materials and shapes of the respective members may be arbitrarily changed.

As described in detail above, according to the present invention, a well-designed keyboard device having an excellent appearance even when viewed from the rear surface side can be provided.

As many apparently widely different embodiments of the present invention can be made without departing from the spirit and scope thereof, it is to be understood that the invention is not limited to the specific embodiments thereof except as defined in the appended claims.

What is claimed is:

1. A keyboard device comprising:

a keyboard main body having plural key tops on a support plate;

a control board provided on a rear surface side of the support plate;

a blocking member provided on the rear surface side of the support plate to cover the control board; and a case, where at least a rear surface side of the case being formed of at least one of transparent resin and translucent resin, accommodating the keyboard main body, the control board and the blocking member, wherein a resin sheet is provided on a rear surface of the support plate, and wherein the resin sheet is bonded to the support plate excepting a region corresponding to an edge of the blocking member positioned on the rear surface side.

* * * * *